US007722413B2

(12) United States Patent
Tonosaki

(10) Patent No.: US 7,722,413 B2
(45) Date of Patent: May 25, 2010

(54) ELECTRICAL CONNECTOR WITH REDUCED PRESS-IN RESISTANCE FOR TERMINALS

(75) Inventor: Takashi Tonosaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/262,347

(22) Filed: Oct. 31, 2008

(65) Prior Publication Data

US 2009/0117755 A1 May 7, 2009

(30) Foreign Application Priority Data

Nov. 2, 2007 (JP) ..... 2007-286011

(51) Int. Cl.
*H01R 13/42* (2006.01)

(52) U.S. Cl. ..... 439/751; 439/82; 439/733.1

(58) Field of Classification Search ..... 439/751, 439/82, 733.1, 869, 741, 444
See application file for complete search history.

(56) References Cited

U.S. PATENT DOCUMENTS 3,530,422 A 9/1970 Goodman
5,073,119 A * 12/1991 Soes ..... 439/82
5,489,221 A * 2/1996 Fujiura et al. ..... 439/733.1
5,639,255 A 6/1997 Muzslay
5,896,655 A * 4/1999 Knodler ..... 29/884
6,042,389 A 3/2000 Lemke et al.
7,037,146 B2 * 5/2006 Nakamura ..... 439/751
7,175,480 B2 * 2/2007 Yamashita ..... 439/733.1
7,361,031 B2 * 4/2008 Matsumura ..... 439/82
2004/0219841 A1 11/2004 Yamashita
2005/0159038 A1 7/2005 Tsuchiya

FOREIGN PATENT DOCUMENTS

JP 2006-019228 1/2006

* cited by examiner

*Primary Examiner*—Hae Moon Hyeon
(74) *Attorney, Agent, or Firm*—Gerald E. Hespos; Michael J. Porco

(57) ABSTRACT

A press-in hole (16) of a housing (10) is formed to be gradually wider from the front end toward the rear end, a large dimensional difference between the width of the press-in hole 16 and that of a press-in portion (21) of a tab-shaped terminal (20) is ensured at a front end portion of the press-in hole 16, so that the tab-shaped terminal (20) can be reliably retained in the housing (10). On the other hand, since the dimensional difference between the width of the press-in hole 16 and that of the press-in portion (21) is small at a rear end portion of the press-in hole (16), press-in resistance at an initial stage of a press-in process is reduced.

16 Claims, 8 Drawing Sheets

ELECTRICAL CONNECTOR WITH REDUCED PRESS-IN RESISTANCE FOR TERMINALS

BACKGROUND OF THE INVENTION

1. Field of the Invention

The invention relates to a connector.

2. Description of the Related Art

Japanese Unexamined Patent Publication No. 2006-19228 discloses a connector with a housing made of synthetic resin. The housing has a retaining wall and press-in holes penetrate the retaining wall. The connector also includes tab-shaped terminals that are pressed into the press-in holes. Each tab-shaped terminal has opposite front and rear ends. A long narrow tab-shaped contact is formed at the front end and a press-in portion that is wider than the press-in hole is continuous with the rear end of the tab-shaped contact. The terminal is pressed into the press-in hole with the tab-shaped contact in the lead. The press-in portion then deforms and widens the inner wall of the press-in hole in a press-in process.

The deformation of the inner wall of the press-in hole creates a reaction force and produces a press-in resistance. The press-in hole has a constant width along its length in the above-described conventional connector. As a result, a constant press-in resistance continues to act from the start to the end of the press-in process. The press-in resistance could be decreased by decreasing a difference in width between the press-in hole and the press-in portion. However, such a redesign also would provide an unacceptable reduction in the force for retaining the tab-shaped terminal in the press-in hole. Therefore, it has been conventionally impossible to avoid the large press-in resistance from the start to the end of the press-in process.

The invention was developed in view of the above situation and an object thereof is to reduce press-in resistance without reducing a force for retaining a terminal.

SUMMARY OF THE INVENTION

The invention relates to a connector with a housing made of synthetic resin and formed with at least one press-in hole extending substantially in forward and backward directions. The connector also includes at least one terminal with opposite front and rear ends. A contact is formed at the front end of the terminal and a press-in portion is continuous with the rear end of the contact. The press-in portion is wider than the press-in hole. The terminal is retained in the housing by pressing the press-in portion into the press-in hole in a press-in direction. The press-in hole is formed to be gradually wider from the front end toward the rear end thereof. Thus, a large dimensional difference between the width of the press-in hole and the width of the press-in portion is ensured at a front end portion of the press-in hole for reliably retaining the terminal in the housing. On the other hand, the dimensional difference between the width of the press-in hole and the width of the press-in portion is small at a rear end portion of the press-in hole for reducing the press-in resistance at an initial stage of a press-in process.

A positioning hole preferably is formed in the housing at the front end of the press-in hole. The positioning hole receives to the contact and positions the contact at a proper position in a width direction.

A front part of the press-in portion preferably has a trapezoidal shape oriented to be wider toward the back.

A maximum width of the rear end of the press-in hole preferably is less than the width of the trapezoidal front end.

The inclined side edges of the trapezoidal part contact the opening edge of the press-in hole at the start of the press-in process. Thus, press-in resistance is reduced by the inclination of these inclined side edges.

A biting portion preferably is defined at the front end of the press-in portion. Lateral edges of the biting portion are inclined to narrow the spacing therebetween towards the front and with respect to the press-in direction.

A receiving portion preferably is defined at the front end of the press-in hole. Opposite lateral surfaces of the receiving are inclined to narrow the spacing therebetween with respect to the press-in direction.

An angle formed by the opposite lateral edges of the biting portion preferably is smaller than an angle formed by the opposite lateral inner surfaces of the receiving portion. As a result, the biting portion bites in the receiving portion in the state where the press-in process is completed and the tab-shaped terminal is retained reliably by this biting action.

Triangular or pointed projections preferably are formed on lateral edges of the press-in portion at positions spaced apart in a press-in direction. The projections of the pressed-in terminal bite in the inner side surfaces of the press-in hole to retain the terminal reliably.

The projections preferably are formed so that lines that connect the projecting ends of the projections along the lateral edges of the press-in portion are inclined to narrow the spacing therebetween toward the front.

The press-in portion, including the projections, preferably is tapered towards the front. Thus, press-in resistance is reduced at the initial stage of the press-in process.

An angle defined by the lines that connect the projecting ends of the projections preferably is larger than an angle defined by the opposite lateral inner surfaces of the press-in hole.

An angle of inclination of the slanted edges of first projections with respect to the press-in direction preferably is smaller than angles of inclination of the slanted edges of the other projections and preferably is in the range of about 5° to about 20°, more preferably about 10°.

Opposite lateral inner surfaces in a press-in area of the press-in hole behind the receiving portion preferably are inclined to widen the spacing gradually from the front end towards the rear end. An angle defined by the opposite lateral inner surfaces in this press-in area is smaller than the angle formed by the inner side surfaces of the receiving portion, and preferably is in the range of about 1° to about 5°, more preferably about 2°.

Front ends of the opposite inner side surfaces of the press-in area preferably are substantially continuous with and at an obtuse angle to the rear ends of the inner side surfaces of the receiving portion. Rear ends of the opposite inner side surfaces of the press-in area preferably are substantially continuous with and at an obtuse angle in the range of about 70° to about 90°, more preferably about 80°, to the front surface of a rear recess of the housing arranged behind the press-in hole.

The housing preferably comprises at least one rear recess arranged behind the press-in hole. A front surface of the rear recess preferably is a substantially flat surface arranged at an angle to the press-in direction. A maximum width in the press-in hole preferably is smaller than the minimum width of the rear recess.

The terminal preferably includes a front-stop that contacts a portion of the housing when the terminal reaches a proper press-in position to stop the press-in operation of the terminal is prevented.

These and other features of the invention will become more apparent upon reading the following detailed description of preferred embodiments and accompanying drawings. Even though embodiments are described separately, features may be combined with additional embodiments.

BRIEF DESCRIPTION OF THE DRAWINGS

FIG. 7 is a horizontal section showing a state where the tab-shaped terminal is being pressed in.

FIG. 8 is a vertical section showing a state where the tab-shaped terminal is being pressed in.

DETAILED DESCRIPTION OF THE PREFERRED EMBODIMENTS

Figure 1:
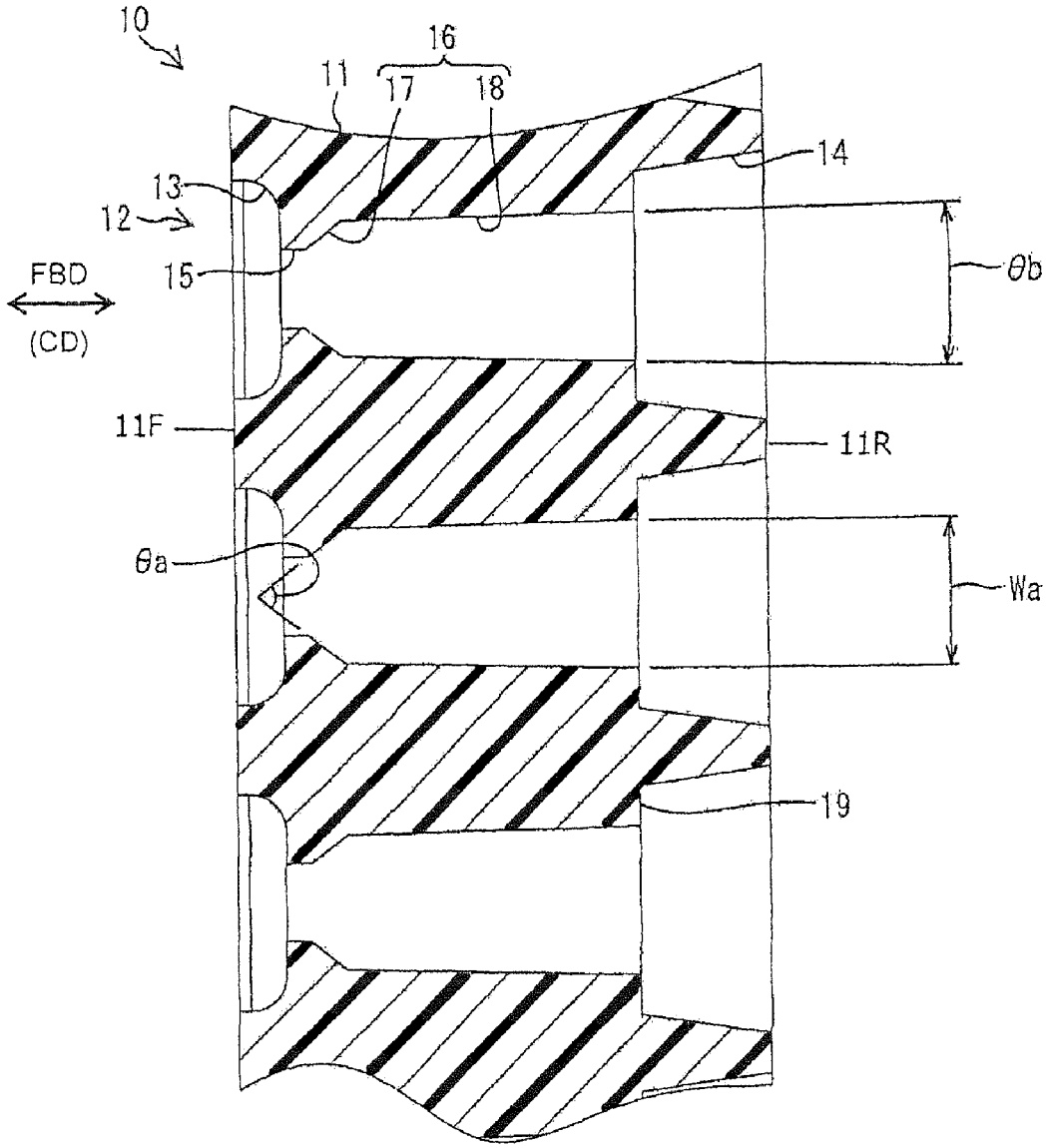
FIG. 1 is a horizontal section of a housing according to one embodiment.
Figure 2:
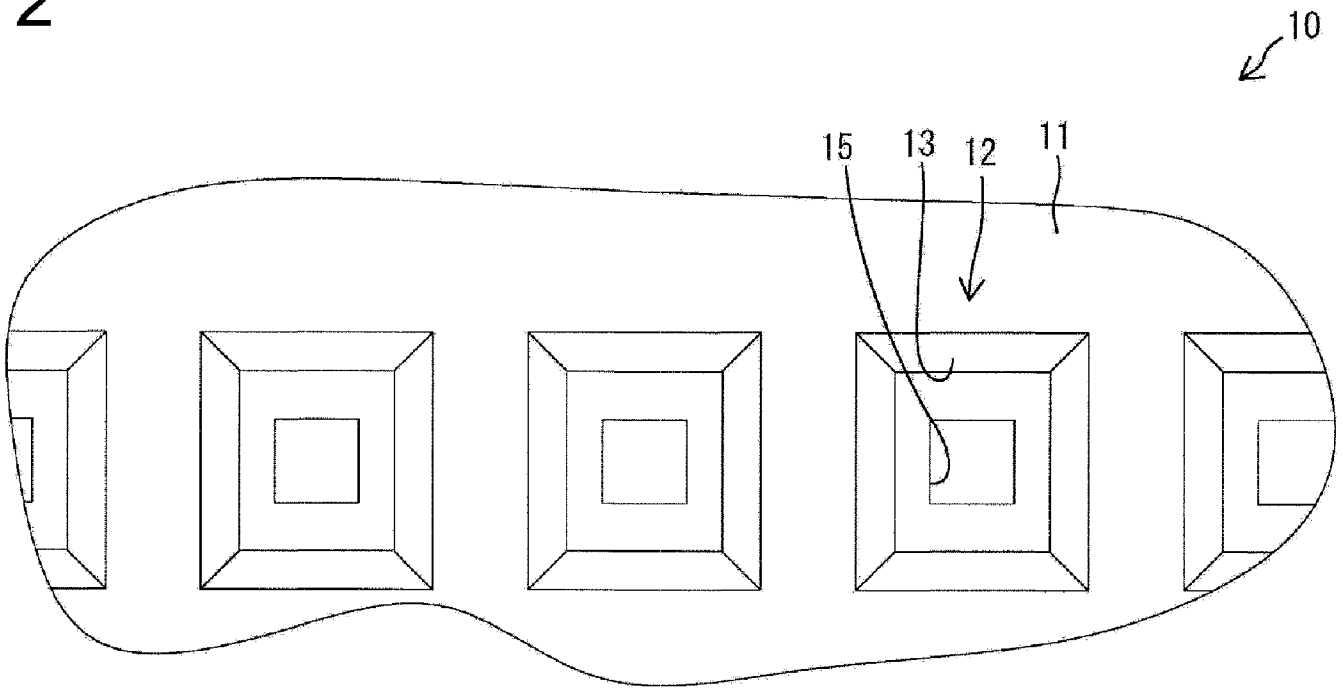
FIG. 2 is a front view of the housing.
Figure 3:
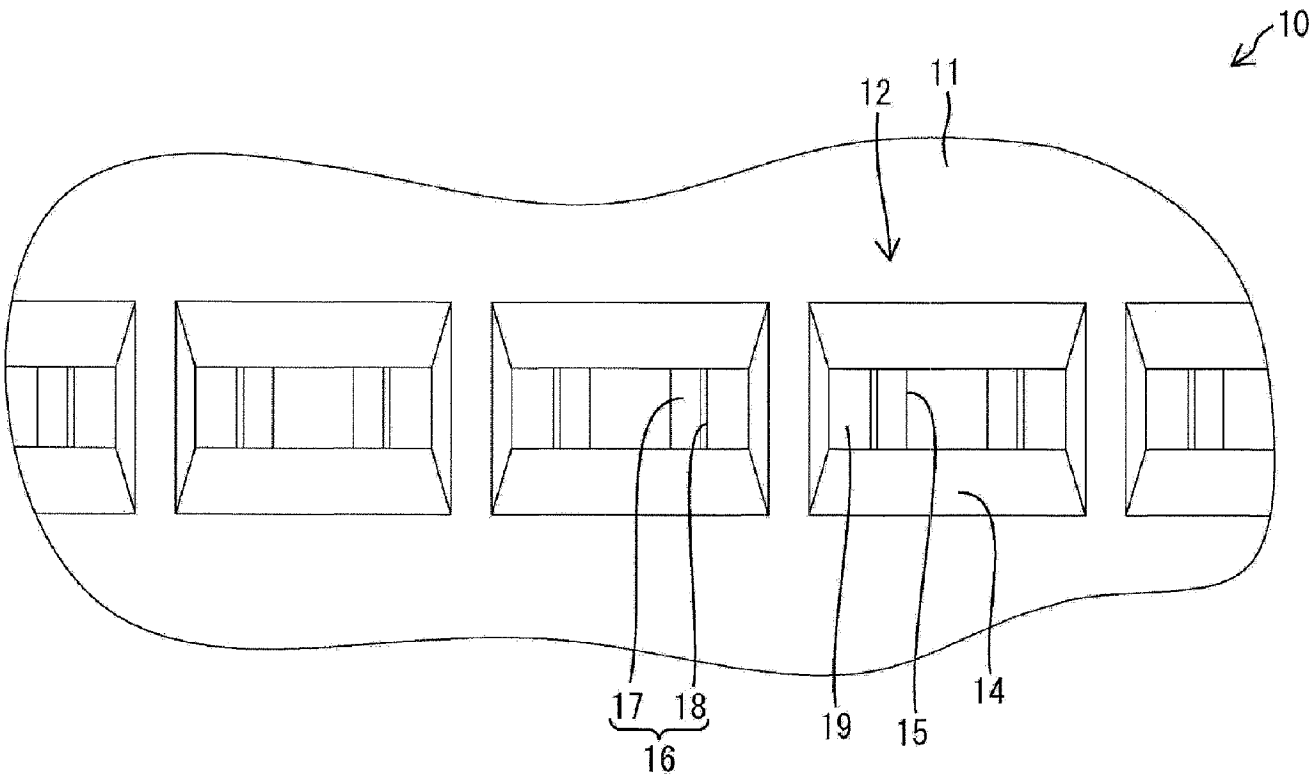
FIG. 3 is a rear view of the housing.

A connector in accordance with the invention is described with reference to FIGS. 1 to 8. The connector includes a housing identified generally by the numeral 10 and tab-shaped terminals 20. The housing 10 is made e.g. of synthetic resin and includes a retaining wall 11 with opposite front and rear surfaces 11F and 11R. Retaining holes 12 penetrate the retaining wall from the front surface 11F to the rear surface 11R in forward and backward directions FBD and substantially parallel to a connecting direction CD with a mating connector. Each retaining hole 12 has a front recess 13 that opens in the front surface 11F of the retaining wall 11, a rear recess 14 that opens in the rear surface 11R of the retaining wall 11, a positioning hole 15 that extends back from the back end surface of the front recess 13, and a press-in hole 16 that extends in forward and backward directions FBD from the back end surface of the positioning hole 15 to the front end surface of the rear recess 14. The retaining hole 12 is substantially laterally and vertically symmetrical with respect to a line parallel to forward and backward directions FBD.

A cross-sectional shape of the front recess 13 at a right angle to a press-in direction ID of the tab-shaped terminal 20 into the retaining hole 12 is substantially square. The positioning hole 15 has a mating substantially square cross-sectional shape substantially concentric with the front recess 13, but smaller than the front recess 13. The rear recess 14 has a wide substantially rectangular cross-sectional shape and the inner surfaces of the rear recess are slanted to widen the rear recess 14 towards the back. A minimum vertical dimension of the rear recess 14 is at the front end of the rear recess 14 and is substantially the same as the vertical dimension of the positioning hole 15. A minimum lateral dimension of the rear recess 14 also is at the front end of the rear recess 14 and is larger than the minimum lateral dimension of the positioning hole 15.

The press-in hole 16 has a wide substantially rectangular cross-section with a vertical dimension that is substantially equal to the vertical dimension of the positioning hole 15. Upper and lower surfaces of the press-in hole 16 are substantially continuous and flush with upper and lower surfaces of the positioning hole 15. A receiving portion 17 is formed at the front end of the press-in hole 16 and has opposite left and right inner surfaces that are inclined to gradually narrow the spacing towards the front. An angle θa formed by the opposite left and right inner surfaces of the receiving portion 17 is close to 90° (e.g. in the range of about 70° to 90°, preferably about 80°). The front ends of the opposite left and right inner surfaces of the receiving portion 17 are substantially continuous with and at an obtuse angle to the rear ends of the inner side surfaces of the positioning hole 15.

A press-in area 18 is defined in the press-in hole 16 behind the receiving portion 17. Opposite left and right inner surfaces of the press-in area 18 are inclined to gradually widen the spacing from the front end towards the rear end. An angle θb formed by the opposite left and right inner surfaces in the press-in area 18 is smaller than the angle θa formed by the inner side surfaces of the receiving portion 17 and is in the range of about 1° to about 5°, more preferably about 2°. The front ends of the opposite inner side surfaces of the press-in area 18 are substantially continuous with and at an obtuse angle to the rear ends of the inner side surfaces of the receiving portion 17. The rear ends of the opposite inner side surfaces of the press-in area 18 are substantially continuous with and at an obtuse angle close to 90° (e.g. in the range of about 70° to 90°, preferably about 80°) to the front surface of the rear recess 14. The front surface of the rear recess 14 defines a stopper 19 that is substantially flat and substantially normal to the press-in direction ID (forward and backward directions FBD) of the tab-shaped terminal 20 into the retaining hole 12. A width Wa at the rear end of the press-in area 18 (i.e. maximum width in the press-in hole 16) is smaller than the minimum width of the rear recess 14.

Each tab-shaped terminal 20 is obtained by punching, stamping or pressing a conductive (preferably metal) plate material into a specified shape and includes a press-in portion 21. A tab-shaped contact 22 extends forward from the front end of the press-in portion 21, a front-stop 23 extends back from the rear end of the press-in portion 21 and a board connecting portion 24 extends back from the rear end of the front-stop 23. The tab-shaped terminal 20 is laterally symmetrical with respect to a line extending in forward and backward directions FBD substantially parallel to the press-in direction ID into the retaining hole 12. Additionally, the tab-shaped terminal 20 is vertically symmetrical in a state where the board connecting portion 24 is not bent. The press-in portion 21, the tab-shaped contact 22 and the front-stop 23 have upper and lower surfaces substantially continuous and flush with each other and have the same thickness.

A cross-sectional shape of the tab-shaped contact 22 at a right angle to the press-in direction is square and the vertical and lateral dimensions of the tab-shaped contact 22 are equal to or slightly smaller than the vertical and lateral dimensions of the positioning hole 15. The front-stop 23 is rectangular and the front end edge of the front stop is normal to the press-in direction. Although not shown, the board connecting portion 24 has a known shape and can be bent in an L-shape and connected with a circuit board or other electric/electronic device (not shown) while being inserted through a through hole of the circuit board.

The vertical dimension of the press-in portion 21 is substantially equal to the vertical dimension of the tab-shaped contact 22. The lateral dimension of the press-in portion 21 is larger than the lateral dimension of the tab-shaped contact 22 and smaller than the lateral dimension of the front-stop 23. First to third substantially triangular projections 25A, 25B and 25C are formed on each of the opposite left and right edges of the press-in portion 21 and are spaced apart in the press-in direction ID. The projections 25A, 25B and 25C have slanted edges 26A, 26B and 26C inclined to the press-in direction ID and locking edges 27A, 27B and 27C that face substantially rearward.

Figure 4:
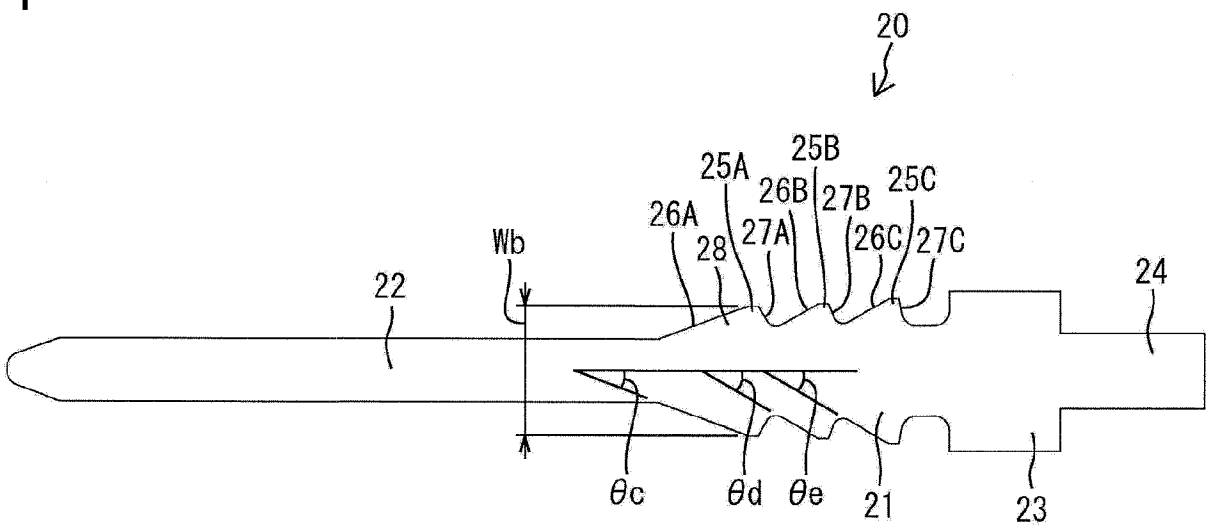
FIG. 4 is a plan view of a tab-shaped terminal.

As shown in FIG. 4, an angle of inclination θc of the slanted edges 26A of the first projections 25A with respect to the press-in direction ID is smaller than angles of inclination θd, θe of the slanted edges 26B, 26C of the second and/or third projections 25B, 25C with respect to the press-in direction ID and preferably is in the range of about 5° to about 20°, more preferably about 10°. Further, the angle of inclination θd of the slanted edges 26B of the second projections 25B is substantially equal to the angle of inclination θe of the slanted edges 26C of the third projections 25C.

Angles of the locking edges 27A, 27B and 27C of the respective projections 25A, 25B and 25C with respect to the press-in direction ID are different from each other. The locking edges 27A of the first or front projections 25A are at an angle of about 90° to the slanted edges 26A. An angle between the locking edges 27B and the slanted edges 26B of the second or middle projections 25B is smaller than the corresponding angle of the first projections 25A. An angle between the locking edges 27C and the slanted edges 26C of the third or rearmost projections 25C is smallest. Thus, the angular orientations of the slanted edges with respect to the insertion direction ID gradually decrease from the front slanted edge towards the back slanted edge. The locking edges 27C of the third projections 25C are closest to a right angle to the press-in direction. In other words, the angular orientations of the locking edges with respect to the insertion direction ID gradually increase from the front towards the rear as seen with respect to the insertion direction ID.

Figure 5:
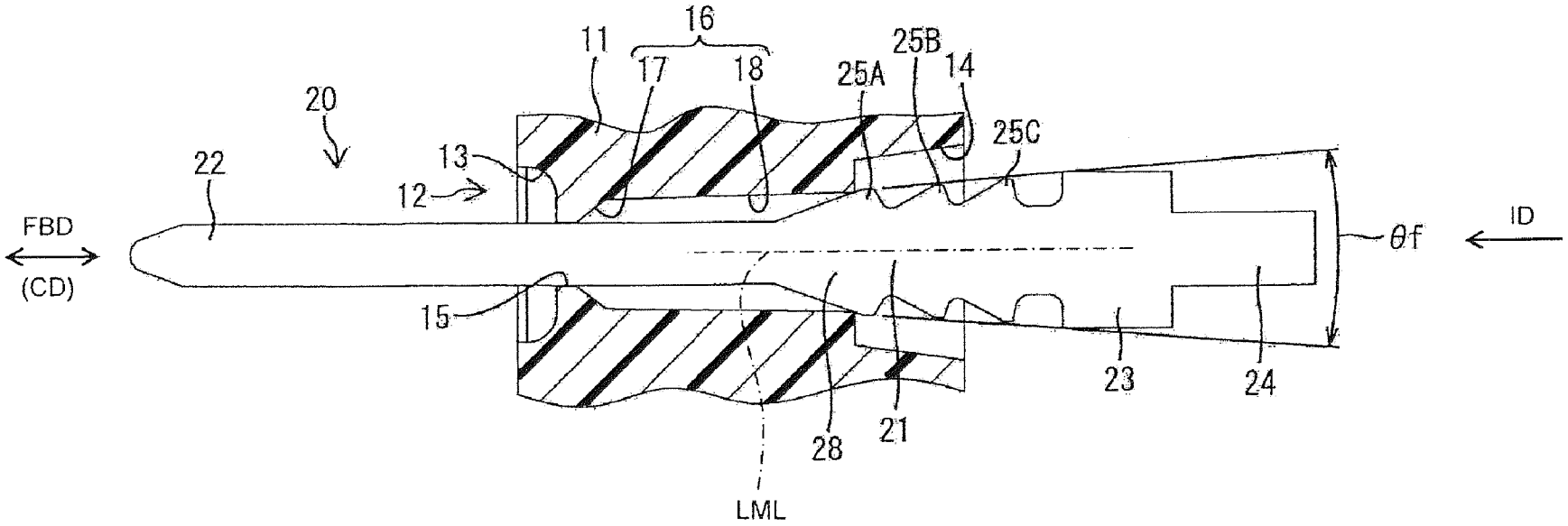
FIG. 5 is a horizontal section showing a state where a press-in process of the tab-shaped terminal is started.

As shown in FIG. 5, lines connecting projecting ends of the three pairs of projections 25A, 25B and 25C along the opposite left and right edges of the press-in portion 21 are inclined with respect to the inserting direction so as to approach a longitudinal middle line LML of the press-in portion 21 and so as to narrow the spacing between the opposite lines towards the front. An angle θf defined by two lines connecting the projecting ends of the projections 25A, 25B and 25C exceeds the angle θb formed by the opposite left and right inner surfaces in the press-in area 18 of the press-in hole 16.

A trapezoidal biting portion 28 is formed by the pair of first projections 25A at the front end of the press-in portion 21, and a maximum width Wb of the biting portion 28 between the projecting ends of the first projections 25A exceeds the maximum width Wa at the rear end of the press-in hole 16. An angle 2×θc formed by the slanted edges 26A of the biting portion 28 is smaller than the angle θa formed by the opposite left and right surfaces of the receiving portion 17. The front ends of the slanted edges 26A of the biting portion 28 are substantially continuous with and at an obtuse angle to the lateral edges of the rear end of the tab-shaped contact 22.

The tab-shaped terminal 20 is inserted into the retaining hole 12 from behind and with the tab-shaped contact 22 in the lead. The tab-shaped contact 22 is through the press-in hole 16 and into fit into the positioning hole 15. Thus, the tab-shaped contact 22 cannot make relative movements in the vertical and/or lateral directions. The press-in 21 is behind the retaining hole 12 when the tab-shaped contact 22 starts being fit into the positioning hole 15.

Figure 6:
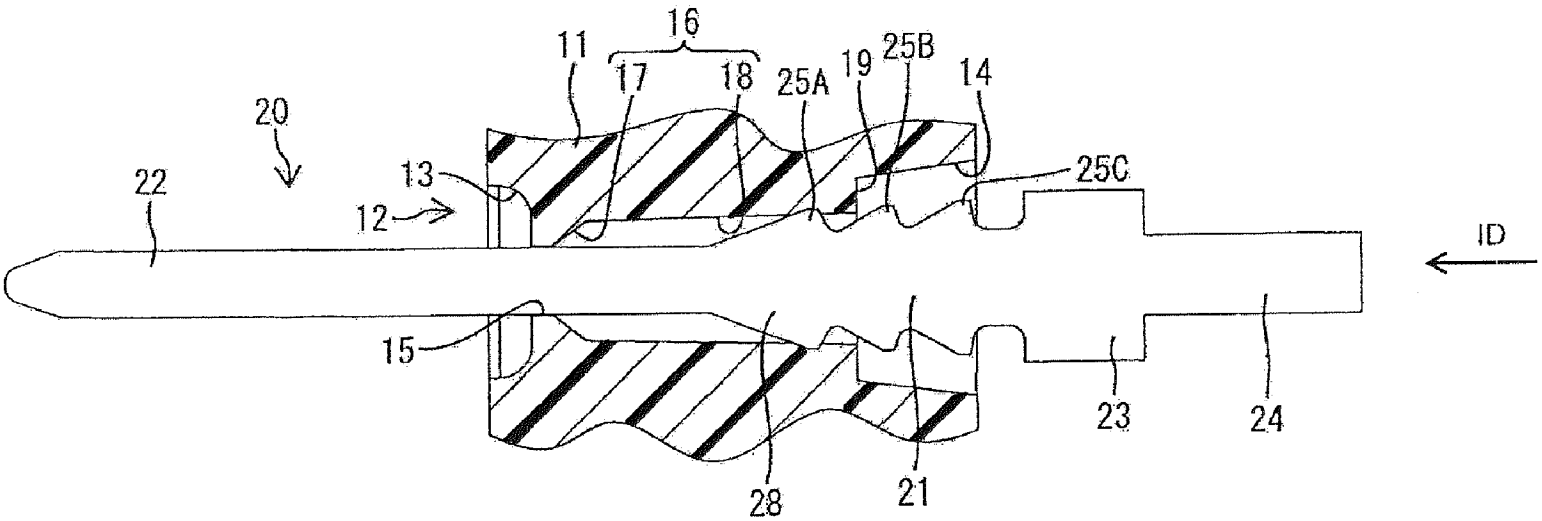
FIG. 6 is a horizontal section showing an intermediate state of the press-in process of the tab-shaped terminal.

If the insertion of the tab-shaped terminal 20 is continued in this state, the slanted edges 26A of the opposite left and right first projections 25A of the trapezoidal biting portion 28 of the press-in portion 21 contact the opening edge at the rear end of the press-in area 18 with the tab-shaped contact 22 fit in the positioning hole 15, as shown in FIG. 5. This contact of the first projections 25A corrects the posture of the tab-shaped terminal 20 in the lateral direction to substantially face in the correct press-in direction ID. A pressing force then is applied to the tab-shaped terminal 20 to press the press-in portion 21 into the press-in hole 16. In the press-in process, as shown in FIG. 6, the first projections 25A move forward in the press-in hole 16 while deforming the opposite left and right inner walls of the press-in area 18 to widen the press-in area 18. Subsequently, the second projections 25B enter the press-in hole 16 and move farther forward while deforming the inner side surfaces of the press-in area 18 to widen the press-in area 18. The third projections 25C similarly are pressed in while deforming the inner side surfaces of the press-in area 18 to widen the press-in area 18.

Figure 7:
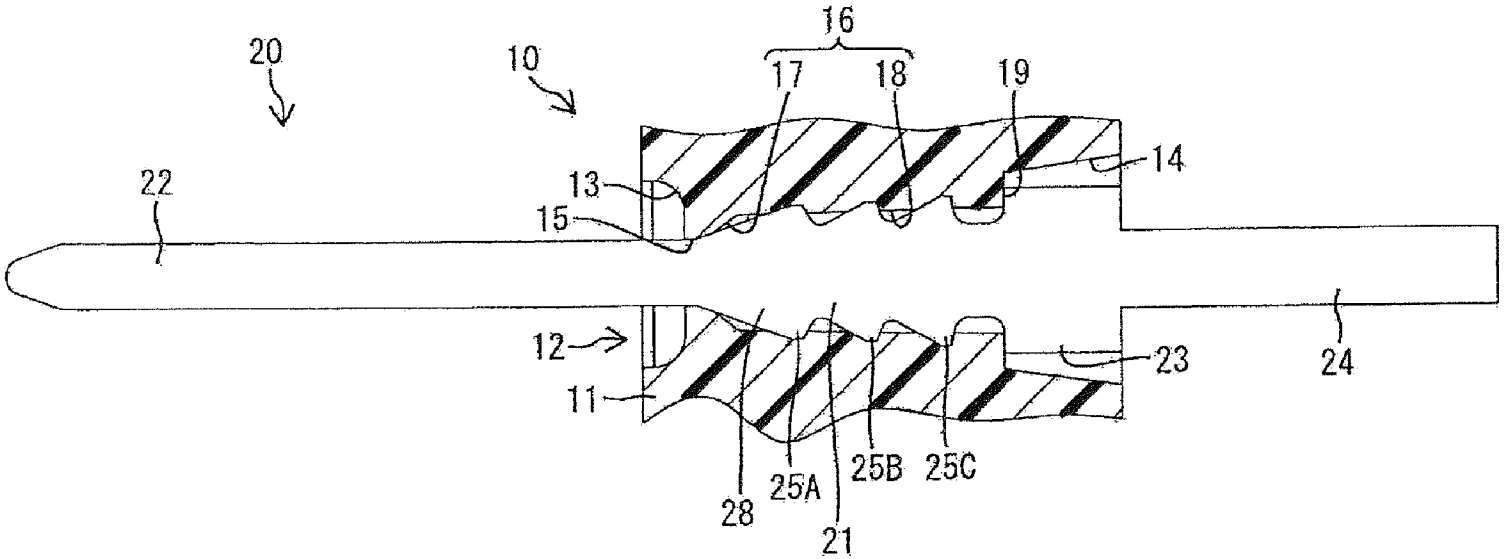
Figure 8:
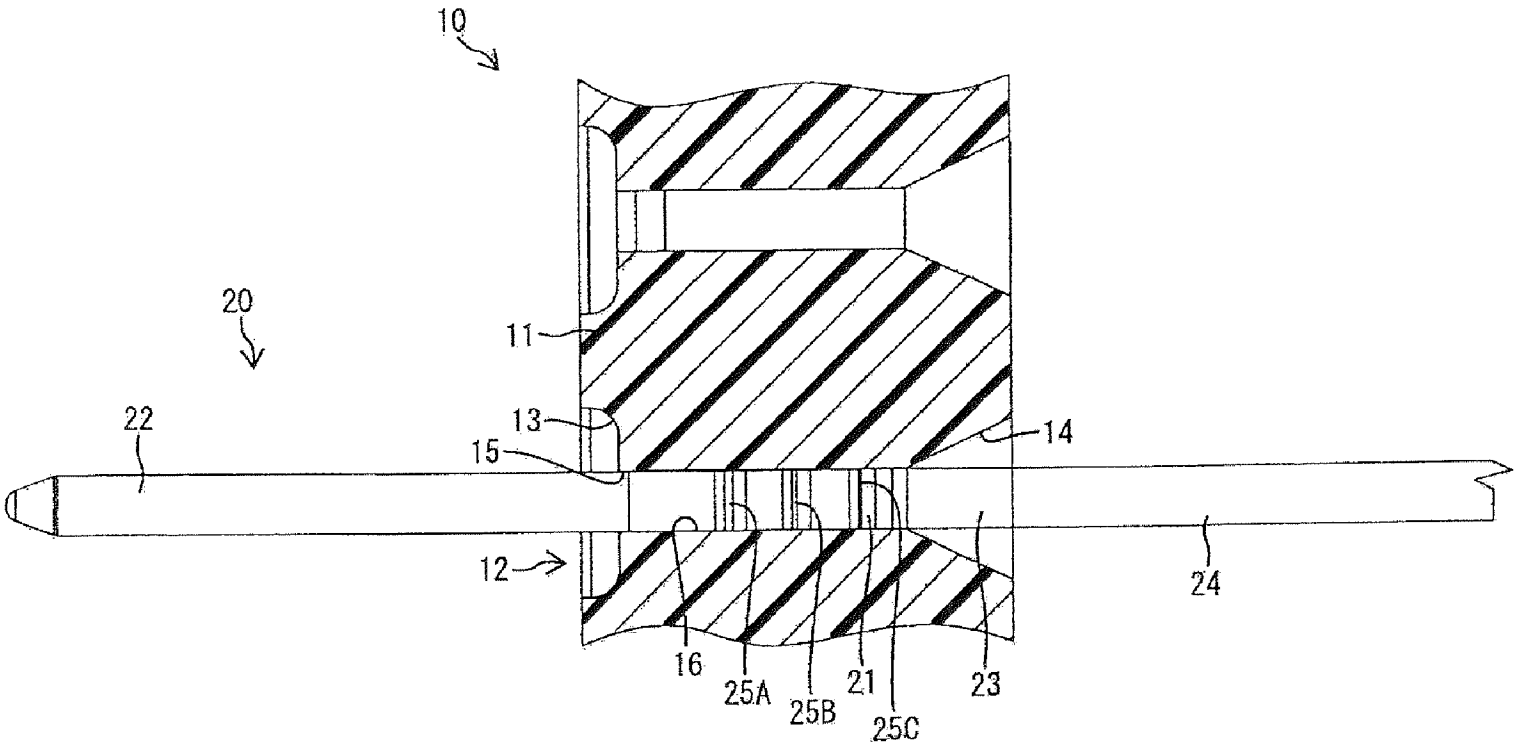

When the tab-shaped terminal 20 reaches a proper press-in position, the front-stop 23 contact the stopper 19 at the back end surface of the rear recess 14, as shown in FIG. 7 to prevent any further press-in of the tab-shaped terminal 20 and the projections 25A, 25B and 25C bite in the inner walls of the press-in hole 16 to prevent a returning movement of the tab-shaped terminal 20. Further, the front end of the biting portion 28 bites in the inner side surfaces of the front end portion of the receiving portion 17 and the opening edge at the rear end of the positioning hole 15.

As described above, the press-in hole 16 is tapered to be gradually wider from the front end towards the rear end. Thus, a large dimensional difference between the width of the press-in hole 16 and that of the press-in portion 21 is ensured at the front end portion of the press-in hole 16, so that that the tab-shaped terminal 20 is retained reliably in the housing 10. On the other hand, the dimensional difference between the widths of the press-in hole 16 and the press-in portion 21 is small at the rear end of the press-in hole 16 and press-in resistance at an initial stage of the press-in process can be reduced.

The tab-shaped contact portion 22 is positioned in the width direction by the positioning hole 15. Thus, the tab-shaped terminal 20 is mounted at a correct position in the housing 10.

Further, the biting portion 28 at the front of the press-in portion 21 has a diverging shape that widens towards the back. The maximum width Wa at the rear of the press-in hole 16 is smaller than the width Wb of the diverging biting portion 28. Thus, the slanted edges 26A of the biting portion 28 contact the opening edge of the press-in hole 16 at the start of the press-in process, and press-in resistance is reduced by the inclination of the slanted edges 26A.

The biting portion 28 at the front end of the press-in portion 21 has opposite left and right edges inclined to narrow the spacing toward the front. The receiving portion 17 at the front end of the press-in hole 16 has left and right inner surfaces inclined with respect to the inserting direction ID to narrow the spacing towards the front. The angle formed by the opposite left and right slanted edges 26A of the biting portion 28 is smaller than the angle formed by the opposite left and right inner surfaces of the receiving portion 17. Accordingly, the biting portion 28 bites in and engages the receiving portion 17 after the press-in process is completed. Therefore the tab-shaped terminal 20 is retained more reliably by this biting action.

The three pairs of substantially triangular projections 25A, 25B and 25C are formed on opposite left and right edges of the press-in portion 21. The projections 25A, 25B and 25C are spaced apart in the press-in direction ID and bite the inner side surfaces of the press-in hole 16 for reliably retaining the pressed-in tab-shaped terminal 20.

The lines connecting the projecting ends of the projections 25A, 25B and 25C of the three pairs of projections 25A, 25B and 25C along the opposite left and right edges of the press-in portion 21 are inclined with respect to the inserting direction ID to preferably narrow the spacing therebetween towards the front. Additionally, the press-in portion 21 including the projections 25A, 25B and 25C is tapered towards the front end. Therefore, press-in resistance at the initial stage of the press-in process is reduced.

The invention is not limited to the above described embodiment, and the following embodiments also are embraced by the invention.

The housing need not have the positioning holes, and the front ends of the press-in holes may be located in the front surface of the housing.

The front end of the press-in portion may be a rectangle whose front end edge is normal to the press-in direction instead of being trapezoidal.

The maximum width of the rear end of the press-in hole may be larger than the width of the trapezoidal part.

The angle formed by left and right edges of the biting portion may exceed the angle formed by left and right inner surfaces of the receiving portion.

The opposite left and right edges of the press-in portion may be straight instead of having the projections.

The press-in hole and the positioning hole may be connected by a step without the tapered receiving portion at the front end of the press-in hole.

More or fewer than three pairs of projections may be provided.

What is claimed is:

1. A connector, comprising:

a housing made of synthetic resin and formed with at least one press-in hole extending in forward and backward directions and having opposite front and rear ends, the press-in hole being formed to be gradually wider from the front end towards the rear end thereof, a receiving portion at the front end of the press-in hole, the receiving portion having opposite lateral surfaces that are inclined with respect to the press-in direction to narrow a spacing therebetween towards the front; and at least one terminal including a contact at a front end portion and a press-in portion continuous with a rear end of the contact and wider than the press-in hole, a biting portion at the front end of said press-in portion and having opposite lateral edges inclined with respect to the press-in direction to form an angle smaller than an angle formed by the opposite lateral surfaces of the receiving portion, the terminal being retained in the housing by pressing the press-in portion into the press-in hole in a press-in direction.

2. The connector of claim 1, wherein a positioning hole is formed in the housing and is substantially continuous with the front end of the press-in hole, the contact being fit in the positioning hole for positioning the contact in a width direction.

3. The connector of claim 1, wherein biting portion of the press-in portion has a trapezoidal shape that is wider towards the back.

4. The connector of claim 3, wherein a maximum width of the rear end of the press-in hole is smaller than a maximum width of the trapezoidal biting portion.

5. The connector of claim 1, wherein substantially triangular projections are formed on opposite lateral edges of the press-in portion and are spaced apart in a press-in direction.

6. The connector of claim 5, wherein the projections are formed so that lines connecting the projecting ends of the projections along each of the opposite lateral edges of the press-in portion (21) are inclined to narrow a spacing therebetween towards the front.

7. The connector of claim 6, wherein an angle defined by a pair of lines connecting the projecting ends of the projections exceeds an angle defined by opposite lateral inner surfaces of the press-in hole.

8. The connector of claim 5, wherein an angle of inclination of the slanted edges of a first of the projections with respect to the press-in direction is smaller than angles of inclination of the slanted edges of the projections rearward of the first projections with respect to the press-in direction.

9. The connector of claim 8, wherein an angle of inclination of the slanted edges of the first of the projections with respect to the press-in direction is in the range of about 5° to about 20°.

10. The connector of claim 1, wherein the housing comprises at least one rear recess arranged behind the press-in hole, a front surface of the rear recess being substantially flat and substantially normal to the press-in direction, a maximum width of the press-in hole being smaller than a minimum width of the rear recess.

11. The connector of claim 1, wherein the terminal includes a front-stop that contacts a portion of the housing when the terminal reaches a substantially proper press-in position for preventing further forward movement of the terminal.

12. A connector comprising:

a housing made of synthetic resin and formed with at least one press-in hole extending in forward and backward directions and having opposite front and rear ends, the press-in hole being formed to be gradually wider from the front end towards the rear end thereof, a receiving portion at the front end of the press-in hole and having opposite lateral surfaces that are inclined with respect to the press-in direction to narrow a spacing therebetween towards the front, wherein opposite lateral inner surfaces of a press-in area of the press-in hole behind the receiving portion are inclined to gradually widen a spacing from the front end towards the rear end, an angle defined by the opposite lateral inner surfaces of the press-in area being smaller than the angle formed by inner side surfaces of the receiving portion; and at least one terminal including a contact at a front end portion and a press-in portion continuous with a rear end of the contact and wider than the press-in hole, the terminal being retained in the housing by pressing the press-in portion into the press-in hole in a press-in direction.

13. The connector of claim 12, wherein an angle defined by the opposite lateral inner surfaces of the press-in area is in the range of about 1° to about 5°.

14. The connector of claim 12, wherein front ends of opposite inner side surfaces of the press-in area are substantially continuous with and at an obtuse angle to rear ends of inner side surfaces of the receiving portion, rear ends of the opposite inner side surfaces of the press-in area are substantially continuous with and at an obtuse angle in the range of about 70° to about 90° to a front surface of a rear recess of the housing behind the press-in hole.

15. A connector, comprising:

a housing made of synthetic resin and formed with a press-in hole having opposite front and rear ends, a receiving portion at a front end of the press-in hole and having opposite lateral surfaces that are inclined to narrow a spacing therebetween towards the front end, a press-in area extending from the receiving portion to the rear end of the press-in hole, opposite lateral inner surfaces of the press-in area being inclined to gradually widen a spacing to a maximum width at the rear end of the press-in hole, an angle defined by the opposite lateral inner surfaces of the press-in area being smaller than the angle formed by inner side surfaces of the receiving portion; and a terminal including a contact at a front end of the terminal, a press-in portion continuous with a rear end of the contact and wider than the press-in hole, opposite lateral edges at a front end of the press-in portion being inclined with respect to the press-in direction to narrow the spacing between the lateral edges towards the front end of the press-in portion, a maximum width of the press-in portion exceeding the maximum width of the press-in area of the press-in hole, the terminal being retained in the housing by pressing the press-in portion into the press-in hole in a rear to front inserting direction, substantially triangular projections being formed on opposite lateral edges of the press-in portion and being spaced apart in a press-in direction, the projections being formed so that lines connecting projecting ends of the projections along each of the opposite lateral edges of the press-in portion are inclined to narrow a spacing therebetween towards the front, an angle defined by a pair of lines connecting the projecting ends of the projections exceeding an angle defined by opposite lateral inner surfaces of the press-in hole.

16. The connector of claim 15, wherein a positioning hole is formed in the housing and is substantially continuous with the front end of the press-in hole, the contact being fit in the positioning hole for positioning the contact in a width direction.

* * * * *